US005932975A

United States Patent [19]

Wut

[11] Patent Number: 5,932,975

[45] Date of Patent: Aug. 3, 1999

[54] MOTION ACTIVATED ILLUMINATING FOOTWEAR AND LIGHT MODULE THEREFOR WITH FADING AND MEANS FOR DEACTIVATING IN BRIGHT LIGHT

[75] Inventor: Siu Bun Wut, Hong Kong, The Hong Kong Special Administrative Region of the People's Republic of China

[73] Assignee: East Asia Services Ltd., Hong Kong

[21] Appl. No.: 08/883,842

[22] Filed: Jun. 27, 1997

Related U.S. Application Data

[63] Continuation-in-part of application No. 08/669,141, Jun. 24, 1996, Pat. No. 5,866,987.

[51] Int. Cl.[6] ..... H05B 37/00

[52] U.S. Cl. ..... 315/119; 315/149; 362/103

[58] Field of Search ..... 362/103, 800, 362/802; 315/119, 123, 125, 149, 150, 151, 156, 157, 158; 36/137

[56] References Cited

U.S. PATENT DOCUMENTS

| | | | |
|---|---|---|---|
| 4,083,630 | 4/1978 | Mau et al. | 352/91 C |
| 4,848,009 | 7/1989 | Rodgers | 36/137 |
| 5,303,485 | 4/1994 | Goldston et al. | 36/137 |
| 5,406,724 | 4/1995 | Lin | 36/137 |
| 5,408,764 | 4/1995 | Wut | 36/137 |
| 5,457,900 | 10/1995 | Roy | 36/137 |
| 5,461,188 | 10/1995 | Drago et al. | 84/600 |
| 5,477,435 | 12/1995 | Rapisarda et al. | 362/189 |
| 5,495,682 | 3/1996 | Chen | 36/2.6 |
| 5,502,903 | 4/1996 | Barker | 36/137 |

*Primary Examiner*—Don Wong
*Assistant Examiner*—David H. Vu
*Attorney, Agent, or Firm*—Richard M. Goldberg

[57] ABSTRACT

A light module for use with a light source mounted to footwear, includes a battery power supply; a cantilevered coil spring which forms a switch connected between the power supply and the light source and having open and closed states such that the light source emits light at a first illumination intensity when the switch is in the closed state; and a fading control circuit connected to the power supply, the light source and the switch for controlling the supply of power to the light source when the switch changes from the closed to the open state such that the illumination intensity of light from the light source decreases over time to produce a fading effect for a first predetermined period of time, regardless of whether the switch changes back from the open state to the closed state during the first predetermined period of time.

15 Claims, 11 Drawing Sheets

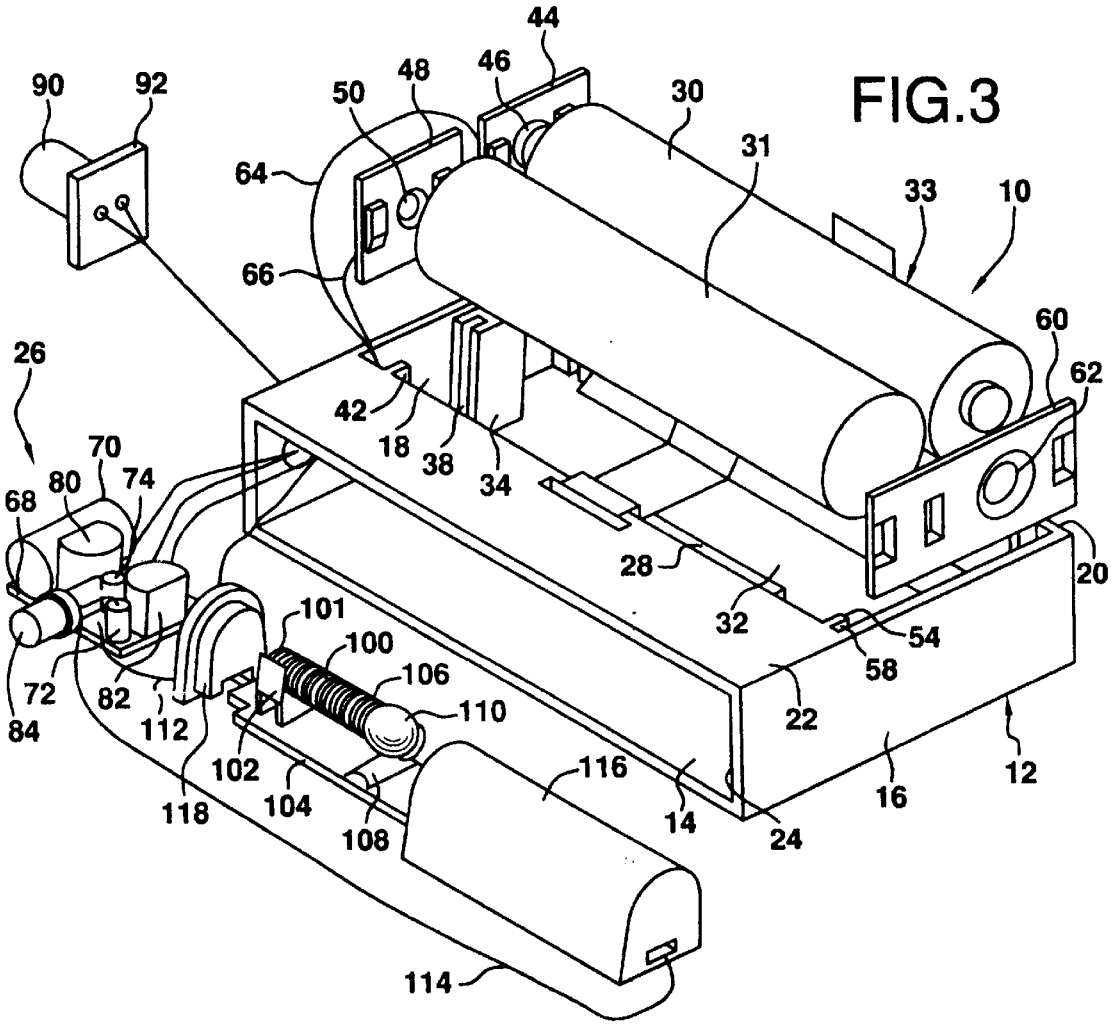
FIG.5
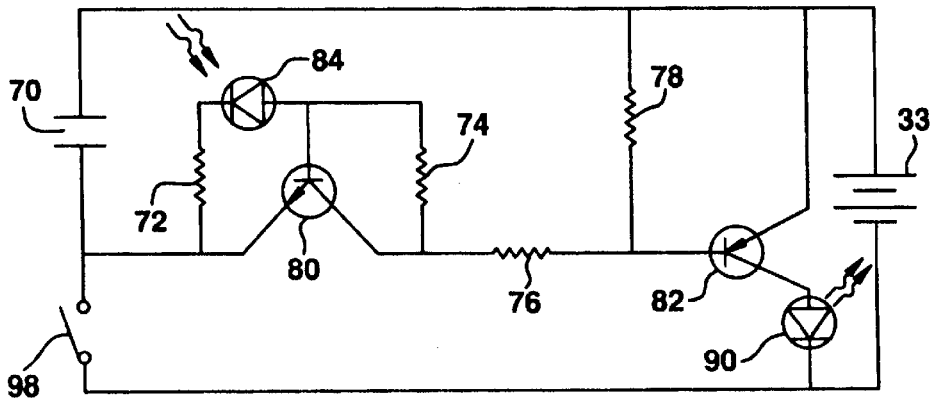

213
210
230
290
292
296
294
212
318
301
300
306
310
302
304
308
226
316
270
278
282
272
280
276
268
274
284

210
213
230
212
270
290
292
284
296
294
282
286
278
288
287
272
274
276
268
226
280
318
302
301
300
306
310
304
308
316

MOTION ACTIVATED ILLUMINATING FOOTWEAR AND LIGHT MODULE THEREFOR WITH FADING AND MEANS FOR DEACTIVATING IN BRIGHT LIGHT

REFERENCE TO RELATED APPLICATION

This application is a Continuation-In-Part application of U.S. patent application Ser. No. 08/669,141, filed Jun. 24, 1996 by Siu Bun Wut and entitled MOTION ACTIVATED ILLUMINATING FOOTWEAR AND LIGHT MODULE THEREFOR WITH FADING AND MEANS FOR DEACTIVATING IN BRIGHT LIGHT, now U.S. Pat. No. 5,866,987.

BACKGROUND OF THE INVENTION

This invention relates to footwear, and more particularly, is directed to motion activated illuminating footwear having a light module therein.

It is well known to position a light inside of a heel of footwear, with the light being activated all of the time. In such known construction, the light can be turned off by means of a switch extending from the heel of the footwear. See, for example, U.S. Pat. No. 4,253,253 to McCormick. However, this construction provides certain disadvantages. First, there is the possibility that the switch is not turned off, in which case the light will burn out in a very short period of time. Second, a connection must be made between the switch on the outside of the heel to the circuitry within the heel, which adds to the cost and complexity of the footwear. Third, there is the possibility that the switch can be damaged, for example, by banging the shoe against an object, since the switch is externally accessible.

For the above reasons, it is preferred to position the entire circuitry and switch therefor entirely within the heel of the footwear. In this regard, it is well known to position a light, such as a light emitting diode (LED) inside of the heel of footwear, such that the light is visible from the exterior of the footwear, with the light being activated by means of a pressure sensitive switch. In particular, when the wearer steps down and exerts pressure on the pressure sensitive switch when walking or running, a circuit is closed so as to supply power to activate the LED. When the wearer steps up, relieving pressure from the pressure sensitive switch, the circuit is opened so as disconnect power to the LED. Examples of such footwear are disclosed in U.S. Pat. No. 5,188,447 to Chiang et al, European Patent Application No. 0 121 026, and U.S. Pat. No. 3,800,133 to Duval. However, the use of a pressure sensitive switch and the associated circuit connections increases the cost and complexity of the footwear.

It is also known to position a light inside of the heel of footwear, with the light being activated by a mercury tilt switch in the footwear. See, for example, German Offenlegungsschrift No. 2,608,485, the aforementioned European Patent Application No. 0 121 026, U.S. Pat. No. 4,158,922 to Dana, III, U.S. Pat. No. 4,848,009 to Rodgers and U.S. Pat. No. 3,893,247 to Dana, III. However, the addition of the mercury tilt switch and the associated circuitry greatly adds to the cost and complexity of the footwear.

U.S. Pat. No. 5,408,764 to Wut, the entire disclosure of which is incorporated herein by reference, discloses the use of an LED inside of the heel of a shoe, and which is intermittently activated by movement of the shoe. Specifically, when the shoe is moved, the free end of a coil spring which is fixed in a cantilevered manner, is caused to intermittently complete the electrical circuit to supply current to the LED.

However, the LED is activated at all times, that is, even in the daytime. Since illumination by the LED is not noticeable during the daytime, such illumination is wasteful and results in unnecessary usage of the battery.

Further, with all of the above assemblies, the LED is either entirely off or on at a set intensity. In other words, there are no times when the LED is illuminated at different intensities.

U.S. Pat. No. 5,406,724 discloses footwear which uses a photoresistive switch connected between the battery and the LEDs so that the LEDs are only lit at night or darkness for saving power consumption of the battery. However, this device does not disclose illumination at different or varied intensities, let alone in conjunction with the photoresistive switch.

OBJECTS AND SUMMARY OF THE INVENTION

Accordingly, it is an object of the present invention to provide motion activated illuminating footwear that overcomes the problems with the aforementioned prior art.

It is another object of the present invention to provide motion activated illuminating footwear having a fading effect in which the light produces an illumination of decreasing intensity.

It is still another object of the present invention to provide motion activated illuminating footwear in which the fading effect occurs for a predetermined period of time after the switch is changed from its closed or on state to its open or off state, regardless of whether the switch is changed back from its open state to its closed state.

It is yet another object of the present invention to provide motion activated illuminating footwear in which the light is prevented from being turned on when the environment has at least a predetermined brightness, and provided in conjunction with the fading effect.

It is a further of the present invention to provide motion activated illuminating footwear that does not require any costly and complex circuitry.

In accordance with an aspect of the present invention, a light module for use with a light source mounted to footwear, includes a power supply for supplying power; a switch connected between the power supply and the light source and having an open state and a closed state such that the light source is activated to emit light at a first illumination intensity when the switch is in the closed state; and a fading control circuit connected to the power supply, the light source and the switch for controlling the supply of power to the light source when the switch changes from the closed state to the open state such that the illumination intensity of light emitted from the light source decreases over time to produce a fading effect for a first predetermined period of time, regardless of whether the switch changes back from the open state to the closed state during the first predetermined period of time.

The fading control circuit is an integrated circuit, and supplies full power to the light source when the switch is in the closed state in response to closing of the switch, except during the first predetermined period of time having the fading effect.

The fading control circuit includes a timing circuit for producing timing signals; a power control circuit for controlling the amount of power supplied to the light source; and a trigger control circuit for controlling operation of the power control circuit in response to a condition of the switch such that the power control circuit reduces the supply of power to the light source over time when the switch changes from the closed state to the open state to produce the fading effect for the first predetermined period of time, regardless of whether the switch changes back from the open state to the closed state during the first predetermined period of time.

The power control circuit includes a down counter which is enabled by the trigger control circuit when the switch changes from the closed state to the open state; and a pulse width modulator which transforms an output from the down counter into a pulse width modulated signal corresponding to an amount of power to be supplied to the light source. Preferably, the pulse width modulator includes a digital to analog converter, and the down counter provides an output signal corresponding to a decay waveform for the first predetermined period.

The down counter further produces an output signal corresponding to a quiescent state during a second predetermined period following the first predetermined period, and the trigger control circuit prevents activation of the fading control circuit to prevent the supply of power to the light source during the second predetermined period. Preferably, the first predetermined period is approximately two seconds and the second predetermined period is approximately one second.

The timing circuit includes an oscillator for producing an oscillation signal of a predetermined frequency; and a time base circuit that provides signals having different clock frequencies for controlling the fading control circuit.

A switching transistor is connected between the pulse width modulator of the fading control circuit and the light source, for controlling a voltage level supplied to the light source in order to control illumination intensity of the light source.

Preferably, the switch includes a coil spring connected in a cantilevered manner such that one end of the spring is electrically connected to the power supply and an opposite free end of the spring intermittently connects with a contact to provide the opening and closing of the switch, whereby to intermittently connect the power supply with the fading control circuit.

Also, the power supply includes at least one battery, and the light source includes at least one light emitting diode.

The above and other objects, features and advantages of the invention will become readily apparent from the following detailed description thereof which is to be read in connection with the accompanying drawings.

BRIEF DESCRIPTION OF THE DRAWINGS

FIG. 3 is a partially exploded perspective view of a light module of the motion activated illuminating footwear according to one embodiment of the present invention;

FIG. 5 is a circuit wiring diagram showing the equivalent electric circuitry for the light module of FIG. 3;

DETAILED DESCRIPTION OF THE PREFERRED EMBODIMENTS

Figure 1:
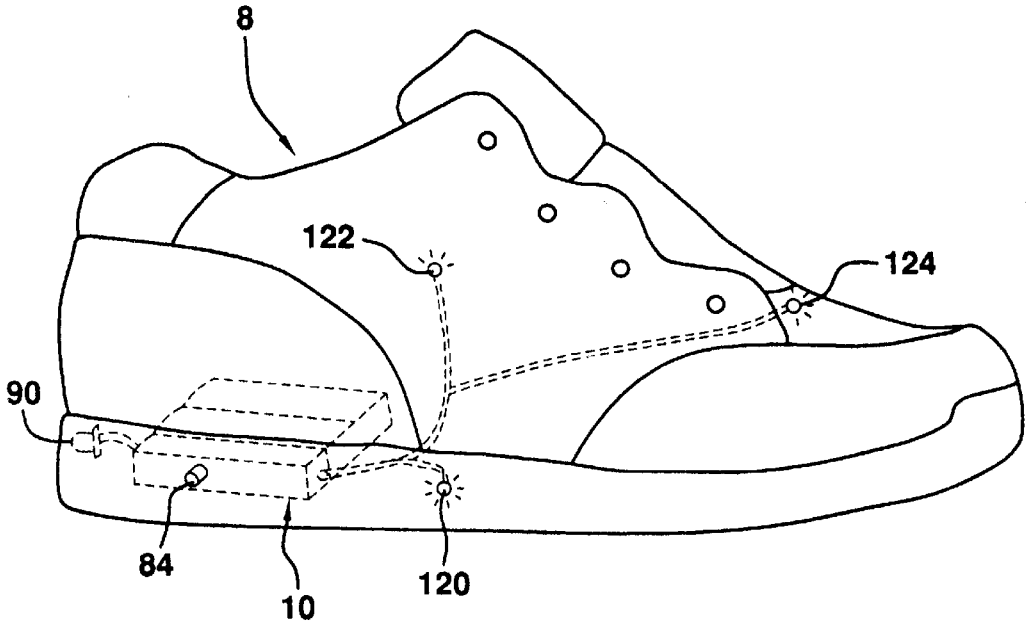
FIG. 1 is a perspective view of a running shoe, with the location of the light module shown in phantom therein.

Referring to the drawings in detail, and initially to FIGS. 1–5 thereof, footwear 8 such as a running shoe or the like includes a light module 10, according to a first embodiment of the present invention, incorporated into the heel of the footwear, in a similar manner to U.S. Pat. No. 5,408,764.

Light module 10 includes a plastic housing 12 including a rectangular bottom wall 14, a front wall 16, a rear wall 18, a right side wall 20 and a top wall 22. Side walls 16, 18 and 20 form a rectangular enclosure having the same dimensions as bottom wall 14 and are secured thereto. The left side 24 is entirely open so that circuitry 26, which will be described hereinafter, can be mounted therein. Further, top wall 22 has a large opening 28 through which two batteries 30 and 31 can be inserted into a battery compartment 32 in housing 12 for powering the circuitry. Batteries 30 and 31 can, for example, be AAA batteries, although the present invention is not limited thereto. Housing 12 can be made of any suitable material, but is preferably made from an acrylic material.

Batteries 30 and 31 are connected in series in battery compartment 32, as will now be described, to form a power supply 33.

A projecting wall 34 having an H-shaped cross-section in a horizontal plane, extends inwardly from the inner surface of rear wall 18, at a position which substantially bisects battery compartment 32. Accordingly, projecting wall 34 includes oppositely facing vertical slits 36 and 38 which are parallel to rear wall 18. The height of projecting wall 34, and thereby of slits 36 and 38, is slightly less than the height of rear wall 18. A vertical slit 40 is provided in right side wall 20 in alignment with and parallel to vertical slit 36, and a vertical alignment stub wall 42 extends the full height of housing 12 and is secured between bottom wall 14 and top wall 22 at the left side of opening 28 and in alignment with the front edge of projecting wall 34.

With this arrangement, a first metal plate 44 having a coil spring 46 extending therefrom is held within vertical slits 36 and 40, such that coil spring 46 contacts the negative terminal of battery 30, while a second metal plate 48 having a raised battery contact portion 50 is held within vertical slit 38 and restrained by vertical alignment wall 42, such that raised battery contact portion 50 contacts the positive terminal of battery 31.

Two inwardly directed short walls 52 and 54, each having a height which is the same as housing 12, extend in slightly spaced relation to the inner surface of front wall 16, and at opposite sides of battery compartment 32, so as to define two opposing vertical slits 56 and 58. A metal plate 60 is held within vertical slits 56 and 58, with metal plate 60 including a raised battery contact portion 62 which contacts the positive terminal of battery 30 and a coil spring (not shown) which contacts the negative terminal of battery 31.

In this manner, batteries 30 and 31 are connected in series, with the input and output thereof being taken across metal plates 44 and 48. Thus, a wire 64 has one end connected to metal plate 44, and a wire 66 has one end connected to metal plate 48, in order to power circuitry 26.

A printed circuit board 68 is provided for mounting in housing 12 through open left side 24. Circuitry 26 includes a capacitor 70, four resistors 72, 74, 76 and 78, and two transistors 80 and 82 mounted on printed circuit board 68, in a manner which will be described hereinafter.

Figure 2:
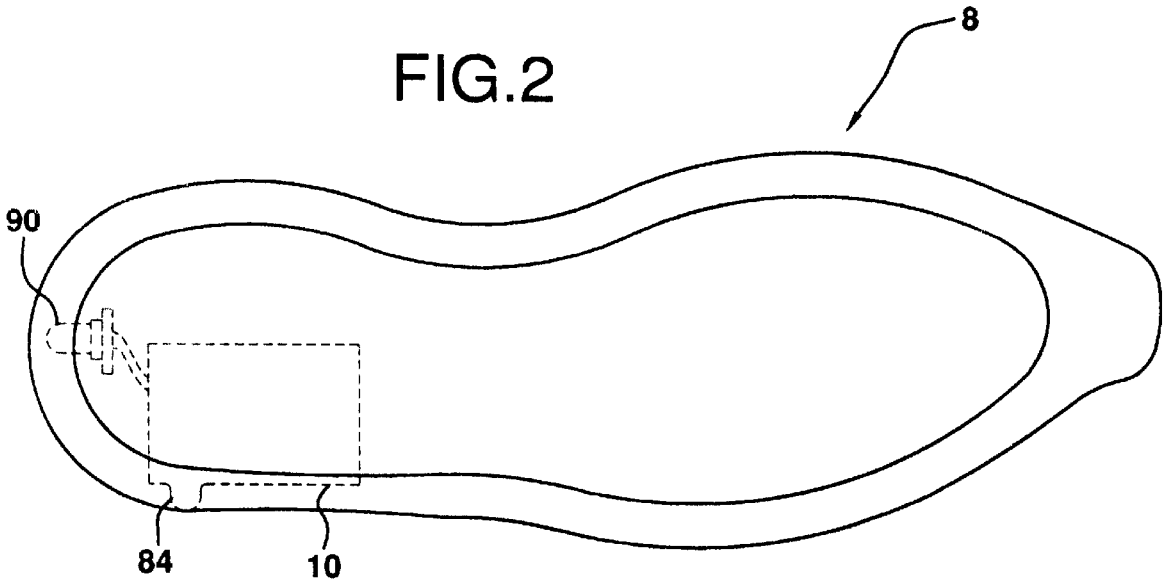
FIG. 2 is a bottom plan view of the running shoe of FIG. 1, with the light module shown in phantom therein.
Figure 4:
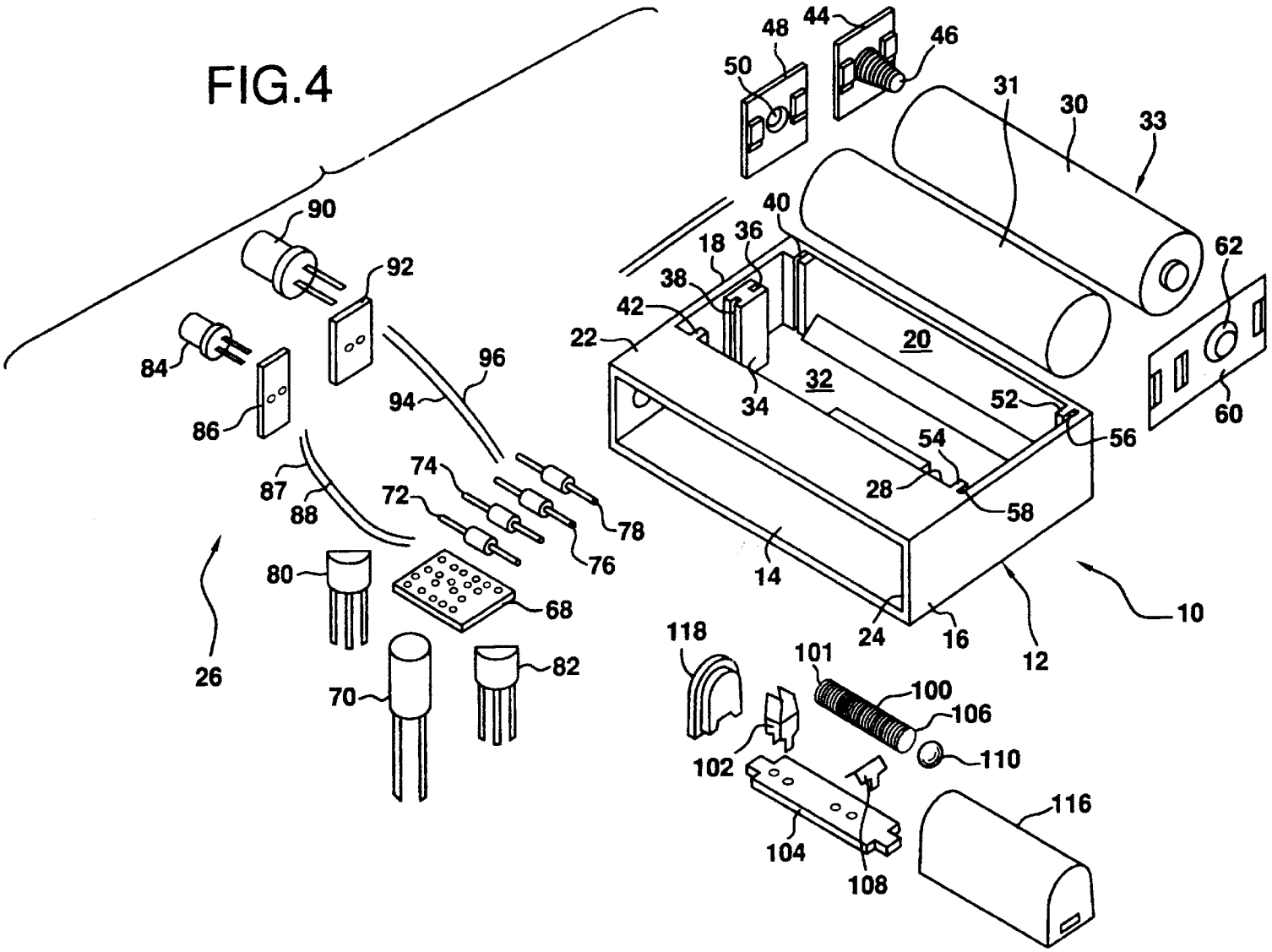
FIG. 4 is a fully exploded perspective view of a light module of FIG. 3.

Further, circuitry 26 includes a photosensor 84 mounted on a printed circuit board 86 and connected to various circuit elements on printed circuit board 68 by means of wires 87 and 88. Preferably, photosensor 84 is a photoconductive diode sensor. Printed circuit board 86 is arranged such that photosensor 84 is exposed to light at the side of footwear 8, as shown in FIGS. 1 and 2, to detect bright light such as daylight or darkness such as nighttime. Printed circuit board 86 is mounted in housing 12 through open left side 24.

Still further, circuitry 26 includes a light source 90, such as a red light emitting diode (LED) mounted on a printed circuit board 92 and connected to various circuit elements on printed circuit board 68 by means of wires 94 and 96. LED 90 is intended to be illuminated only when light is below a threshold value, for example, at night, and only in the manner specified hereinafter. It is preferred to use a light emitting diode for the light source since an LED provides a relatively high intensity with a relatively low energy consumption when compared with other conventional incandescent illumination devices. The low energy consumption enables the use of a smaller size and less costly battery compared to other light sources. This size reduction is of utmost importance in footwear. Further, LEDs are also available in assorted color lightings.

The last circuit element of circuitry 26 is a switch 98 illustrated schematically in the circuit of FIG. 5. Switch 98 is formed by a coil spring 100 having one end 101 thereof fixedly mounted to a spring holder 102 that is mounted to one end of an elongated printed circuit board 104. The opposite end 106 of coil spring 100 is free, such that coil spring 100 is mounted in a cantilevered manner on printed circuit board 104. Specifically, the opposite free end 106 of coil spring 100 is mounted in spaced relation above a metal arch 108 that is fixed to the opposite end of printed circuit board 104. A weighting ball 110 is secured to the free end 106 of coil spring 100 to ensure that in the stationary position of footwear 8, free end 106 is positioned slightly above, but in spaced relation to, metal arch 108.

Spring holder 102 and thereby the fixed end 101 of coil spring 100, are connected by electric wire 112 to printed circuit board 68, while metal arch 108 and thereby free end 106 of coil spring 100 when it contacts metal arch 108, are also connected by electric wire 114 to printed circuit board 68.

Coil spring 100 and printed circuit board 108 are enclosed by an arcuate spring housing 116 having an end closure cap 118. Printed circuit board 68 can be secured to spring housing 116 or end closure cap 118 to provide a unitary assembly.

The schematic circuit diagram with all connections for circuitry 26 is shown in FIG. 5.

Specifically, transistor 80 is shown as an NPN bipolar junction transistor, although it is not so limited. Transistor 80 is connected in a common-base configuration, with a series circuit of resistor 74, diode photosensor 84 and resistor 72, connected between the collector and emitter of transistor 80, and with the base of transistor 80 being connected to the junction of resistor 74 with photosensor 84. Resistor 78 is connected between the base of transistor 82 and the positive terminal of power supply 33.

Photosensor 84 is provided to detect the brightness of the surrounding environment, and is set for a predetermined brightness.

With such arrangement, during daylight, that is, when the surrounding environment is brighter than the predetermined brightness set for photosensor 84, the internal resistance of photosensor 84 decreases. Thus, current will flow through the path of resistor 74, photosensor 84 and resistor 72, and not through the base of transistor 80. As a result, transistor 80 will be turned off, so that no current will flow through the emitter-collector path thereof.

During this time, when switch 98 is closed, the voltage supply will begin from the positive terminal of power supply 33, and then through the base-emitter path of transistor 82, resistors 78, 76 and 74, photosensor 84, resistor 72, switch 98 and back to the negative terminal of power supply 33. However, this voltage supply is weak and is insufficient to turn on the emitter-collector paths of transistors 80 and 82. Thus, LED 90 will not be activated to emit light.

On the other hand, at night, when photosensor 84 is not illuminated with bright light of at least a predetermined brightness, the internal resistance of photosensor 84 increases. Due to the high resistance of photosensor 84 and resistor 72, only a small portion of current flows through photosensor 84 and resistor 72. At this time, the current will therefore flow through the base of transistor 80, to turn on transistor 80, with the major portion of current then flowing through the emitter-collector path of transistor 80.

The collector of transistor 80 is connected through resistor 76 to the base of transistor 82, which is shown as a PNP bipolar junction transistor, although it is not limited to the same. The emitter of transistor 82 is connected to the positive terminal of power supply 33, while the collector is connected through LED 90 to the negative terminal of power supply 33.

During daylight, when transistor 80 is off, no current flows through the emitter-collector path of transistor 80 to the base of transistor 82. Accordingly, transistor 82 is turned off. This means that no current is permitted to flow through the emitter-collector path of transistor 82, so that LED 90 is turned off during the daytime.

During the night, when transistor 80 is on, current flows through the emitter-collector path of transistor 80 to the base of transistor 82. Accordingly, transistor 82 is turned on. This means that current is permitted to flow through the emitter-collector path of transistor 82, so that LED 90 can be turned on during the night.

In particular, switch 98 is connected at one end through capacitor 70 to the positive terminal of power supply 33 and to the emitter of transistor 82, and at its opposite end to the negative terminal of power supply 33 and to LED 90. Thus, the circuit is completed only when switch 98 is closed, that is, when the free end 106 of spring 100 contacts metal arch 108.

Accordingly, when light module 10 is in equilibrium, that is, in a static state when footwear 8 is stationary, free end 106 of coil extension spring 100 is designed not to contact battery metal arch 108. In other words, coil extension spring 100 has a sufficient stiffness so that free end 106 extends horizontally above the upper surface of metal arch 108, as shown in FIG. 3. Thus, no power is supplied to LED 90, and LED 90 will not be illuminated.

However, during the night, when light module 10 is activated by a simple up and down motion, such as occurs in a stepping motion, this motion will vibrate coil extension spring 100, and the vibrating coil extension spring 100 will contact the upper surface of metal arch 108 with each vibration. Each time that coil extension spring 100 contacts metal arch 108, the circuit will be closed and power will be supplied to LED 90 to cause the same to emit light visible to human eyes.

It will be appreciated that each vibration will connect power supply 33, that is, batteries 30 and 31, to LED 90, and also, will function to disconnect power supply 33 from LED 90. Thus, when light module 10 is activated by motion, the circuit will alternate between an ON state and an OFF state. Specifically, in the ON state, coil extension spring 100 contacts metal arch 108 when coil extension spring 100 is moving in a downward motion, which will close the circuit of light module 10.

However, when coil extension spring 100 is in its upward motion, coil extension spring 100 is not in contact with metal arch 108. This upward motion of coil extension spring 100 will open the circuit of light module 10, so that LED 90 will not be illuminated.

Thus, each time the circuit completes these two ON and OFF states, LED 90 will emit light so as to simulate a flashing light. When the circuit is opened and closed by the sequential vibrations of motion, for example, while the person is walking, LED 90 will emit a series of flashes, which will have a flashing effect visible to human eyes.

Weighting ball 110 is added to free end 106 of coil extension spring 100 to add weight thereto and thereby enhance the downward motion which will provide a better connection between coil extension spring 100 and metal arch 108. This better connecting relation between coil extension spring 100 and metal arch 108 provides LED 90 with a more stable power source which, in turn, provides a higher degree of illumination for LED 90. Thus, weighting ball 110 provides a more reliable connecting relation between coil extension spring 100 and metal arch 108, without affecting the upward motion of each vibration. Of course, the characteristics of coil extension spring 100, such as the thickness of the spring and the like, will have to be taken into account to determine the effects of weighting ball 110.

In addition to LED 90 only being capable of being activated at night (or in a dark environment), a fading effect is provided when LED 90 is turned on. Specifically, in darkness, when switch 98 is closed, LED 90 is turned on with a constant intensity of illumination, since LED 90 is powered by capacitor 70 which is fully charged to the voltage of constant power supply 33. However, when switch 98 is opened, LED 90 is powered by the discharge from capacitor 70. Since capacitor 70 is charged when switch 98 is closed, the voltage of capacitor at such time is the same as that of power supply 33. However, when switch 98 is opened, power supply 33 is disconnected, and accordingly, capacitor 70 is discharged to power LED 90. As the voltage decreases during such discharge, the intensity of illumination of LED 90 will consequently decrease. This produces a fading effect, until switch 98 is again closed, whereby the full power of power supply 33 is once again supplied to LED 90. The discharge rate of capacitor 70 is determined by resistors 76 and 78. Hereinafter, reference to a power source will mean the combination of the power supply 33 and capacitor 70, which in combination, provide power to activate LED 90.

Although capacitor 70 will discharge through the emitter-collector path of transistor 82 when switch 98 is open at night, the major portion of the discharge through the circuit travels from capacitor 70, through resistors 78 and 76 and through the collector-emitter path of transistor 80, and back to capacitor 70.

Of course, if footwear 8 moves to a stationary position, capacitor 70 will entirely discharge, and since switch 98 will be open, LED 90 will not be illuminated at all.

In operation, when the surrounding environment detected by photosensor 84 is dark or close to dark, transistor 80 is turned on to permit current flow through the emitter-collector path thereof. When switch 98 is closed, there will be a closed circuit from the positive terminal of power supply 33, through resistors 78 and 76, through transistor 80 and to the negative terminal of power supply 33. This has the effect of turning on transistor 82, whereby LED 90 is powered to emit light in accordance with the full charge on capacitor 70.

When switch 98 is open, that is, free end 106 of spring 100 is not in contact with metal arch 108, the circuit by which capacitor 70 was charged, is broken. Due to the current supplied from capacitor 70 through the emitter-collector path of transistor 80, transistor 82 is retained in its on state. Further, capacitor starts discharging from its full state to a lesser charge. As the charge reduces, the amount of light emitted by LED 90 reduces, to achieve a fading or dimming effect. The rate of discharge of capacitor 70 will depend upon the resistance value of resistors 76 and 78 and on transistor 82.

When capacitor 70 is fully discharged, and switch 98 is open, LED 90 will stop emitting light completely.

When the surrounding environment detected by photosensor 84 is bright, transistor 80 is turned off to prevent current flow through the emitter-collector path thereof.

Thus, the following important aspects are achieved by the present invention:

(a) coil spring 100 is positioned out of direct contact with batteries 30 and 31;

(b) a fading effect is achieved; and (c) no illumination by LED 90 will occur when there is a bright environment.

As an alternative embodiment, as shown in FIG. 1, one or more of LEDs 120, 122 and 124 can be added to circuitry 26 in place or, or in addition to, LED 90. As shown, LED 120 is placed at a lower side portion of footwear 8, LED 122 is placed at an upper side portion of footwear 8, and LED 124 is placed on an upper front portion of footwear 8. In such case, the wiring is placed between the material of the upper of footwear 8 so that the wiring will not be exposed, and the LED is secured to the side and top portions of footwear 8 with glue.

Figure 6:
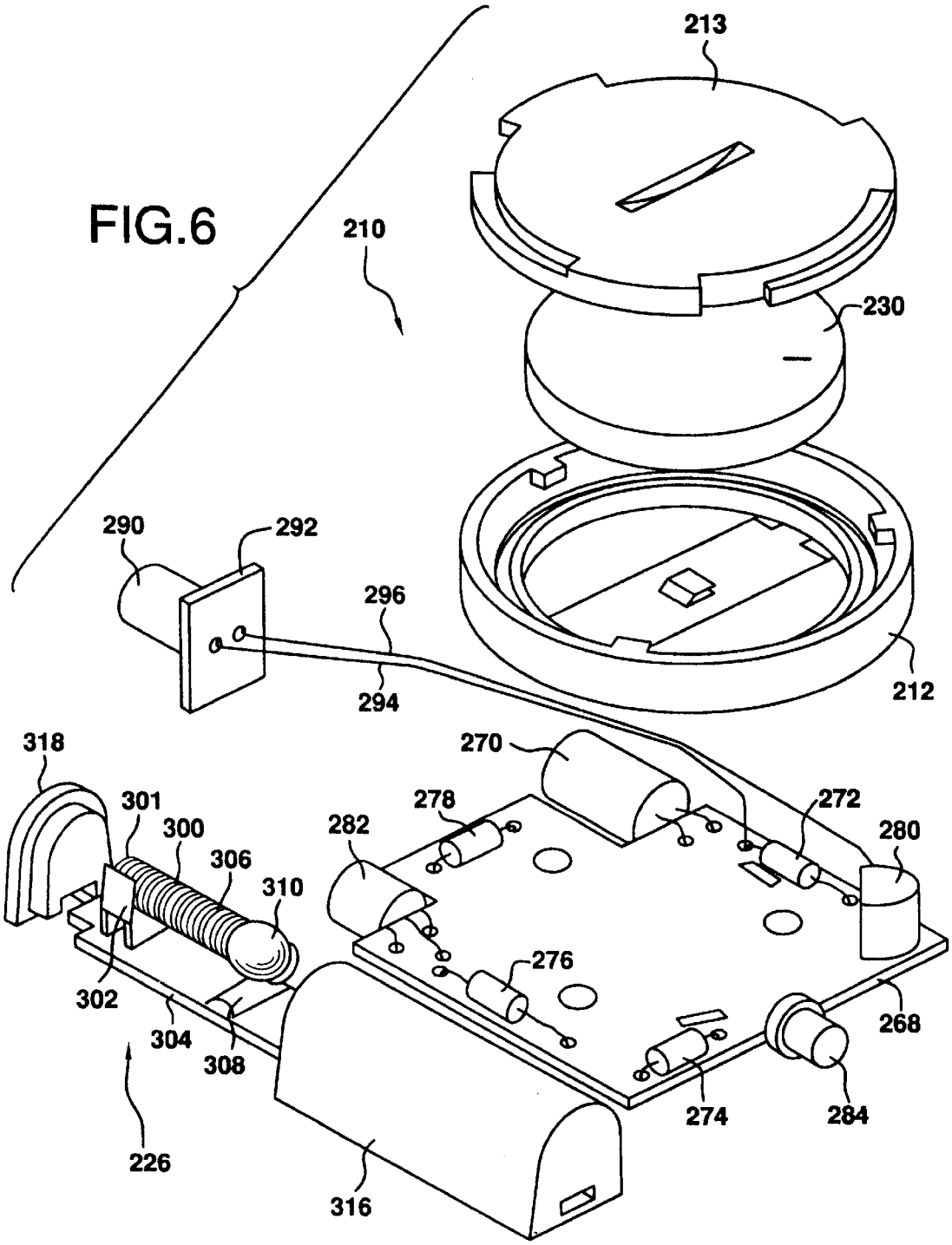
FIG. 6 is a partially exploded perspective view of a light module of the motion activated illuminating footwear according to another embodiment of the present invention.
Figure 7:
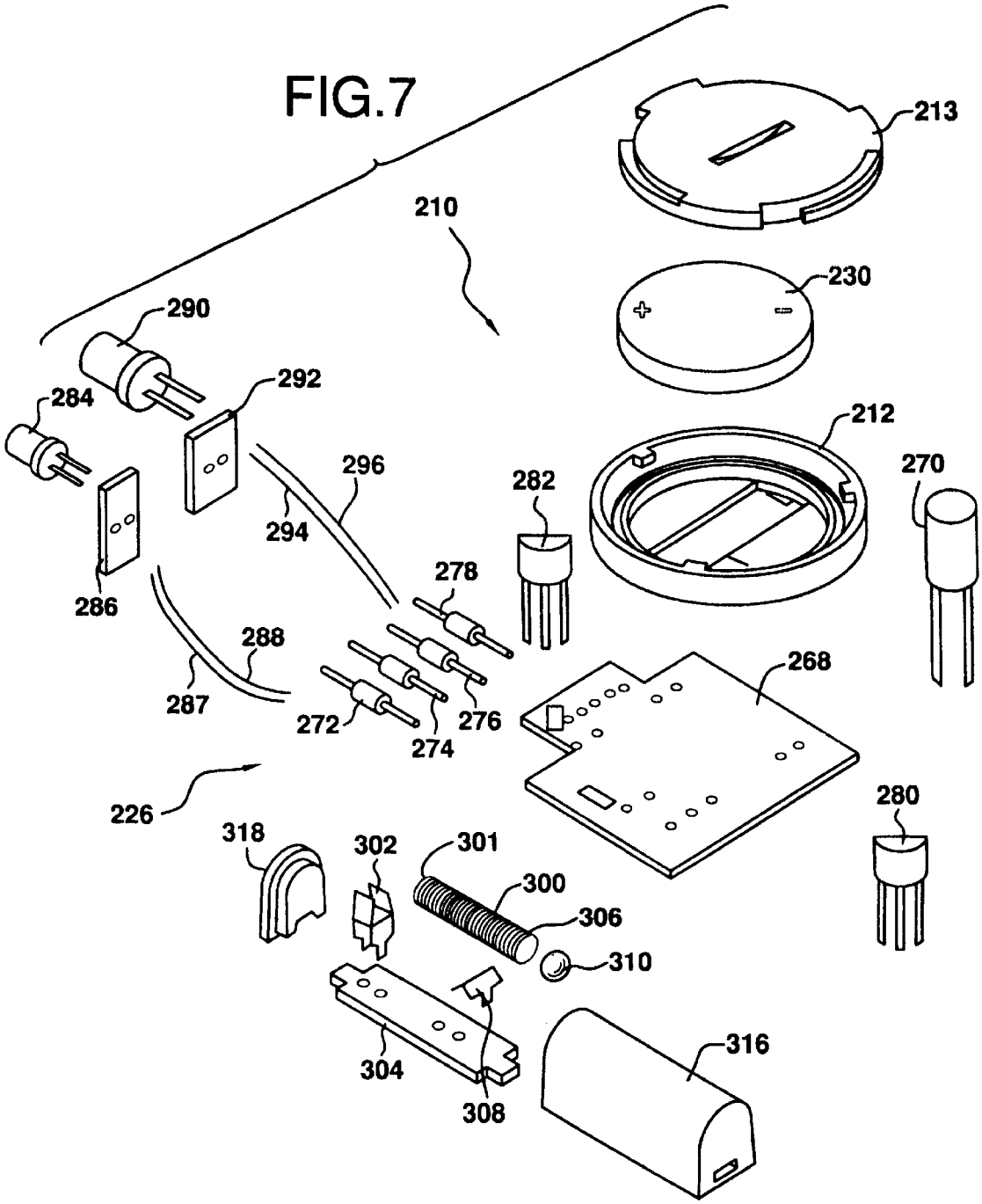
FIG. 7 is a fully exploded perspective view of the light module of FIG. 6.
Figure 8:
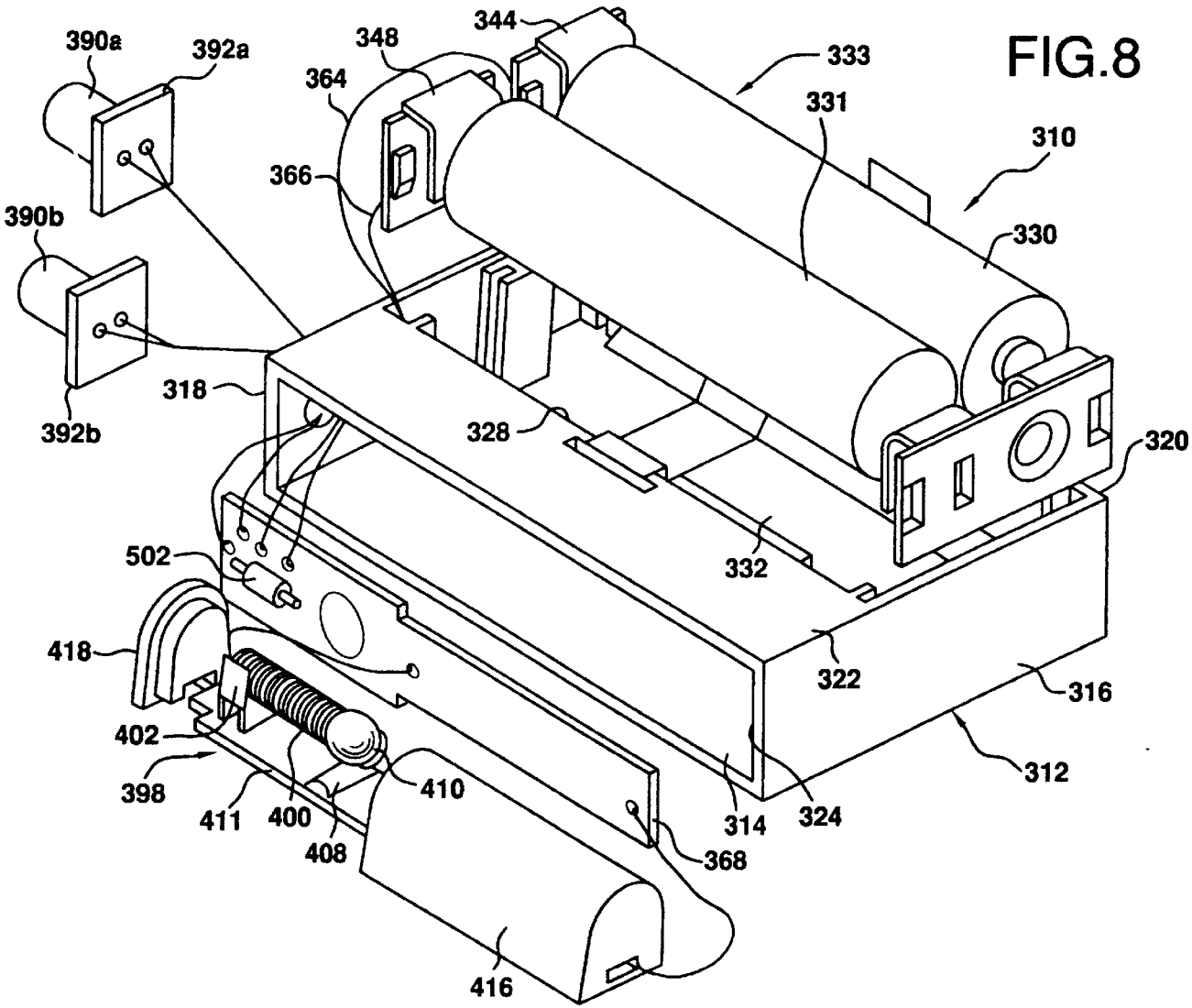
FIG. 8 is a partially exploded perspective view of a light module of the motion activated illuminating footwear according to still another embodiment of the present invention.
Figure 9:
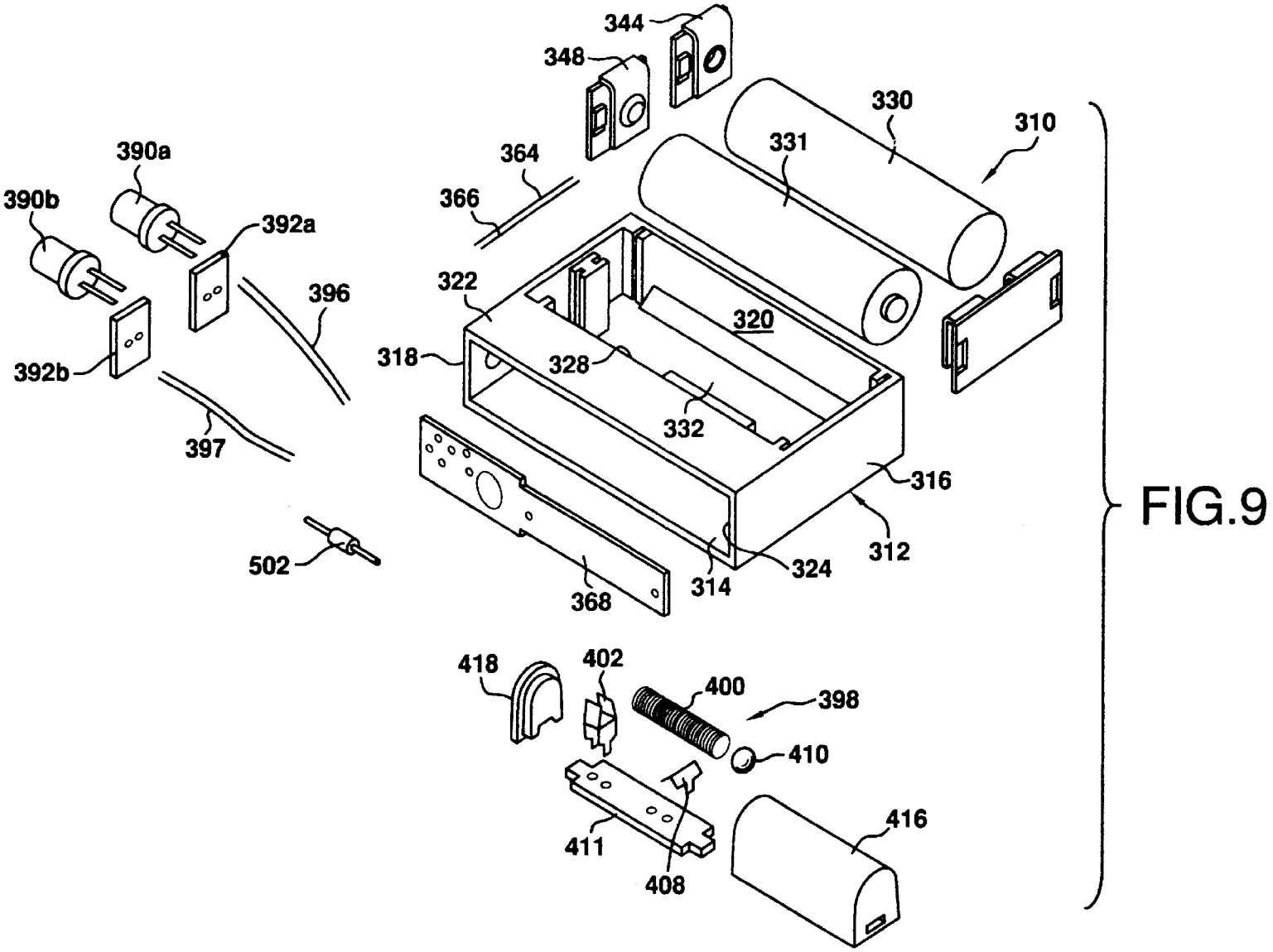
FIG. 9 is a fully exploded perspective view of the light module of FIG. 8.

Referring now to FIGS. 6 and 7, a light module 210 according to another embodiment of the invention will now be described in which the elements corresponding to light module 10 are identified and shown by the same reference numerals, augmented by 200.

As shown therein, in place of the two AAA batteries 30 and 31, there is provided a single lithium battery 230, which is provided in a circular housing 212 having a cover 213 secured thereto with a bayonet type closure. Housing 212 is mounted to the upper surface of printed circuit board 268 between the various circuit elements 270, 272, 274, 276, 280, 282 and 284 mounted on printed circuit board 268. Suitable contacts and/or electric wires are provided which connect battery 230 and/or housing 212 to the various circuit elements to power the same. Of course, a housing (not shown) would also be provided for housing all of the components of FIGS. 6 and 7.

It will be appreciated that the light source (LEDs) are shown apart from the module per se, although the LEDs can also be mounted in the module. In both cases, the LEDs are mounted to the footwear, either independently or as part of the module.

However, when the above light module is subject to quick, continuous movement, the switch, which is formed by coil spring 100, changes between the on state and the off state very quickly. As a result, any discharge of capacitor 70 is small so that the fading effect is minimal. In other words, the LEDs effectively stay at the brightest illumination without any discernable fading effect.

Referring to FIGS. 8–15, a light module 310 according to another embodiment of the present invention will now be described in which elements corresponding to light module 10 are identified and shown by the same reference numerals, augmented by 300, but in which the fading effect occurs for a predetermined period of time after the switch is changed from its closed or on state to its open or off state, regardless of whether the switch is changed back from its open state to its closed state.

Light module 310 includes a plastic housing 312 having a rectangular bottom wall 314, a front wall 316, a rear wall 318, a right side wall 320 and a top wall 322. Side walls 316, 318 and 320 form a rectangular enclosure having the same dimensions as bottom wall 314 and are secured thereto. The left side 324 is entirely open so that circuity, which will be described hereinafter, can be mounted therein. Further, top wall 322 has a large opening 328 through which two batteries 330 and 331 can be inserted into a battery compartment 332 in housing 312 for powering the circuitry. Batteries 330 and 331 can, for example, be AAA batteries, although the present invention is not limited thereto. Housing 312 can be made of any suitable material, but is preferably made from an acrylic material.

Batteries 330 and 331 are connected in series in battery compartment 332 in the same manner as batteries 30 and 31 of the first embodiment, and accordingly, a detailed description of the mounting of the batteries in order to form this series connection is not repeated herein. Accordingly, batteries 330 and 331, which form a power supply 333, are connected in series with the input and output thereof being taken across metal plates 344 and 348, with a wire 364 having one end connected to metal plate 344 and a wire 366 having one end connected to metal plate 348, in order to power the circuitry.

A circuit board 368 is provided for mounting in housing 312 through open left side 324.

The circuitry includes light sources 390*a* and 390*b*, such as red light emitting diodes (LEDs), each mounted on a respective printed circuit board 392*a* and 392*b* and connected to various circuit elements on circuit board 368 by means of wire pairs 396 and 397, respectively.

The circuitry further includes a switch 398 which is identical in all relevant aspects to switch 98 and is formed by a coil spring 400, a spring holder 402 which mounts one end of spring 400 in a cantilevered manner on a printed circuit board 411, a metal arch 408 positioned adjacent the free end of spring 400 on printed circuit board 411, and a weighting ball 410 secured in the same manner as in the first embodiment on a printed circuit board 411. As in the first embodiment, spring 398 is enclosed by an arcuate spring housing 416 having an end closure cap 418.

Figure 10:
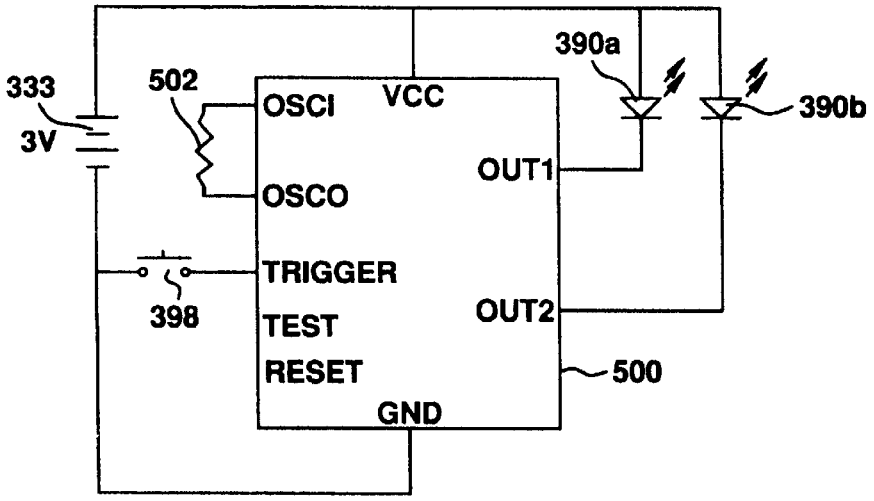
FIG. 10 is a block diagram of the electric circuitry for the light module of FIG. 8, showing the fader IC.

The block diagram for the circuitry is shown in FIG. 10. Specifically, an integrated circuit 500 (CD 6601) for controlling the supply of power to LEDs 390*a* and 390*b* has two outputs OUT 1 and OUT 2 connected to the cathode terminals of LEDs 390*a* and 390*b*, respectively, for supplying power thereto. The opposite anode terminals of LEDs 390*a* and 390*b* are connected to the positive terminal of power supply 333 which supplies a voltage $V_{CC}$, for example, of 3 volts. Voltage $V_{CC}$ is also supplied to one input of integrated circuit 500. The opposite negative terminal of power supply 333 is connected to a ground input GND of integrated circuit 500.

A resistor 502 is connected between an oscillator output terminal OSCO of integrated circuit 500 and an oscillator input terminal OSCI of integrated circuit 500. In addition, switch 398 is connected between the negative terminal of power supply 333 and a trigger input TRIGGER of integrated circuit 500.

In basic operation, when switch 398 is closed, for example, when the weighted end of coil spring 400 contacts arched bridge 408 to close switch 398, full power is supplied from power supply 333 to LEDs 390*a* and 390*b* in order to illuminate the same with full intensity. When the weighted end of coil spring 400 is raised up from arched bridge 408 so as to open switch 398, integrated circuit 500 supplies a decreasing voltage to LEDs 390*a* and 390*b* over a predetermined period of time so that the intensity thereof decreases during this period of time in order to produce a fading effect. This fading effect over the predetermined period of time occurs, regardless of whether switch 398 is closed again, that is, whether the weighted end of coil spring 400 subsequently contacts arched bridge 408. After the predetermined period of time has occurred, if the weighted end of coil spring 400 again contacts arched bridge 408, the above operation repeats itself. As a result, a fading effect which is visible over the predetermined period of time, which may be 2 or 3 seconds, is clearly viewable.

Typical values used with integrated circuit 500 are shown by the following table:

| | MIN. | TYP. | MAX | UNIT | CONDITION |
|---|---|---|---|---|---|
| QUIESCENT CURRENT | | 1 | 5 | μA | |
| OPERATING VOLTAGE | 2.0 | 3 | 3.5 | V | |
| LED OUTPUT CURRENT | | 16 | | mA | $V_{LED}$ = 1 V |
| OSCILLATOR FREQUENCY | | 64 | | KHz | $V_{CC}$ = 3 V |
| KEY INPUT VOLTAGE RANGE | GND 0.5 | | $V_{CC}$ - 0.5 | V | |

Figure 11:
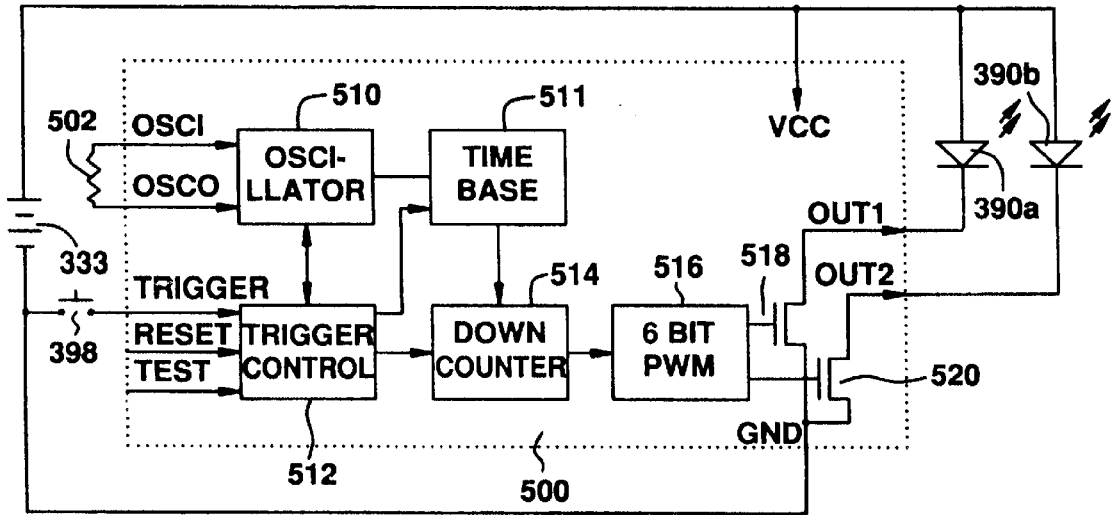
FIG. 11 is a more detailed block diagram of the electric circuitry of the light module of FIG. 8, showing the specific circuitry within the fader IC.

FIG. 11 shows more detailed circuitry of integrated circuit 500. Specifically, integrated circuit 500 includes an oscillator 510 which is preferably an RC-type oscillator that generates a 64 KHz clock signal at the output thereof.

Oscillator input OSCI and oscillator output OSCO are connected with oscillator 510 through resistor 502. The output of oscillator 510 is supplied to a time base circuit 511 of integrated circuit 500, which is preferably a ripple counter that provides different clock frequencies for other circuitry inside integrated circuit 500.

Figure 14A:
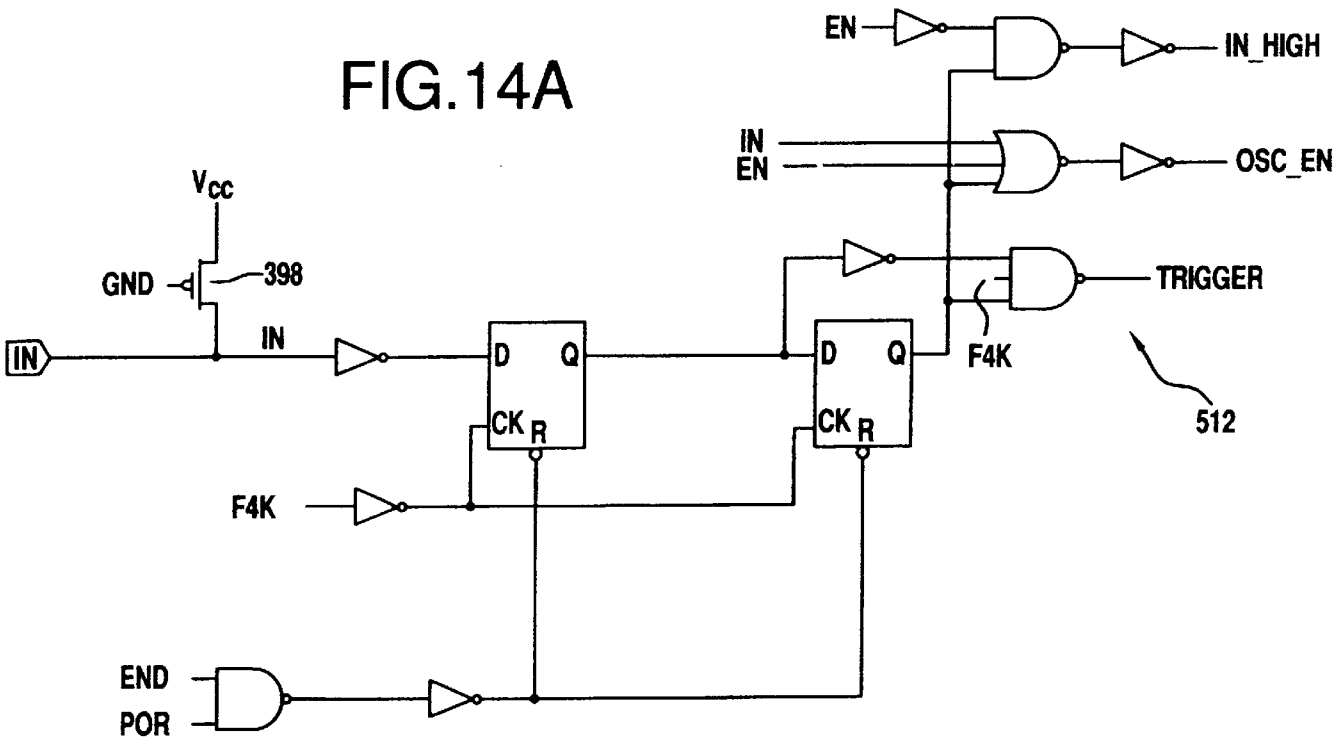
FIG. 14A is a circuit wiring diagram of another portion of the trigger control of the electric circuitry of FIG. 11.

A trigger control circuit 512 of integrated circuit 500 includes the aforementioned trigger input TRIGGER which is activated upon closing and opening of switch 398, as shown in FIGS. 11 and 14A. Trigger control circuit 512 is an input control that activates other circuitry of integrated circuit 500 as will be explained hereinafter. Trigger control circuit 512 produces an output signal OSC_EN which is supplied to oscillator 510 in order to enable the same, a KEY-ON signal TRIGGER which is used to set the two output ports of circuit 500 to a low value, and a KEY-ON signal IN_HIGH which will be discussed hereinafter.

Integrated circuit 500 also includes a down counter 514 which receives an input clock from time base circuit 511 and is enabled by a KEY-OFF signal IN_HIGH from trigger control circuit 512 to generate a decay waveform. The output from down counter 514 is supplied to a six bit pulse width modulator (PWM) circuit 516 which controls two FETs 518 and 520 as switching transistors for controlling the level of the voltages at output terminals OUT 1 and OUT 2 in order to control the illumination intensity of LEDs 390*a* and 390*b*.

Figure 12A:
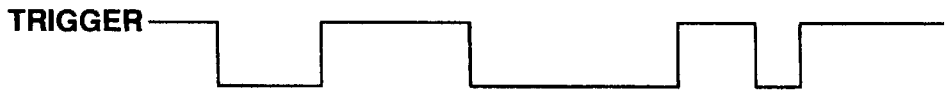
FIGS. 12A and 12B are waveform diagrams for explaining the operation of the circuitry of FIG. 11.
Figure 12B:
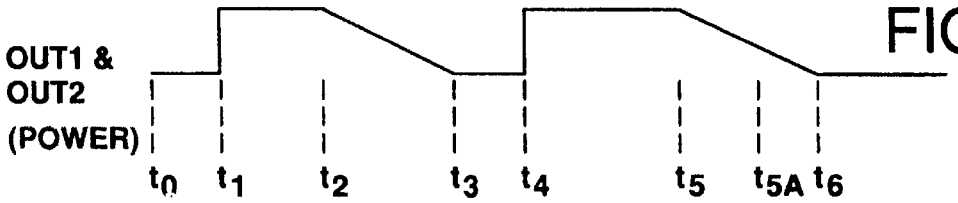

In operation, when switch 398 is closed, as represented at $T_0$ in FIG. 12A, the power at output terminals OUT 1 and OUT 2 is 0, so that the LEDs 390*a* and 390*b* are not illuminated. At time $T_1$, when switch 398 is closed, there is a transition in the trigger input TRIGGER to integrated circuit 500 which causes full power to be supplied by integrated circuit 500 to LEDs 390*a* and 390*b*. This full power continues while switch 398 is closed. At time $T_2$, when switch 398 is opened, there is another transition in the trigger input TRIGGER to integrated circuit 500, which results in integrated circuit 500 supplying a decreasing power or voltage to LEDs 390*a* and 390*b* at output terminals OUT 1 and OUT 2, which decreases in a linear or ramp-like manner for a predetermined period, for example, 2 seconds until time $T_3$ until the power supply to LEDs 390*a* and 390*b* is 0. This is followed by a one-second quiescent period from time $T_3$ to time $T_4$ during which no power is supplied to LEDs 390*a* and 390*b*. During this predetermined time period from $T_2$ to time $T_4$, even if switch 398 is closed again, the fading period from time $T_2$ to time $T_3$ and the quiescent period from time $T_3$ to $T_4$ is not affected. For example, as shown in FIGS. 12A and 12B, there is a transition in the trigger input during the quiescent period between time $T_3$ and $T_4$. However, no change occurs during this time even though switch 398 is closed. At the end of the quiescent period, at time $T_4$, if switch 398 remains closed or is subsequently closed, as shown, full power is supplied to LEDs 390*a* and 390*b*. Accordingly, LEDs 390*a* and 390*b* are fully illuminated.

Subsequent thereto, if there is another transition at time $T_5$ whereby switch 398 is opened, the ramp decay occurs again from time $T_5$ to time $T_6$, followed by the quiescent period thereafter. In the example given, there is a transition at $T_{5A}$ whereby switch 398 is closed during the decay period. However, this does not affect the ramp down of the voltage supplied to output terminals OUT 1 and OUT 2. As a result, even though switch 398 is again closed, the fading effect continues.

Figure 13:
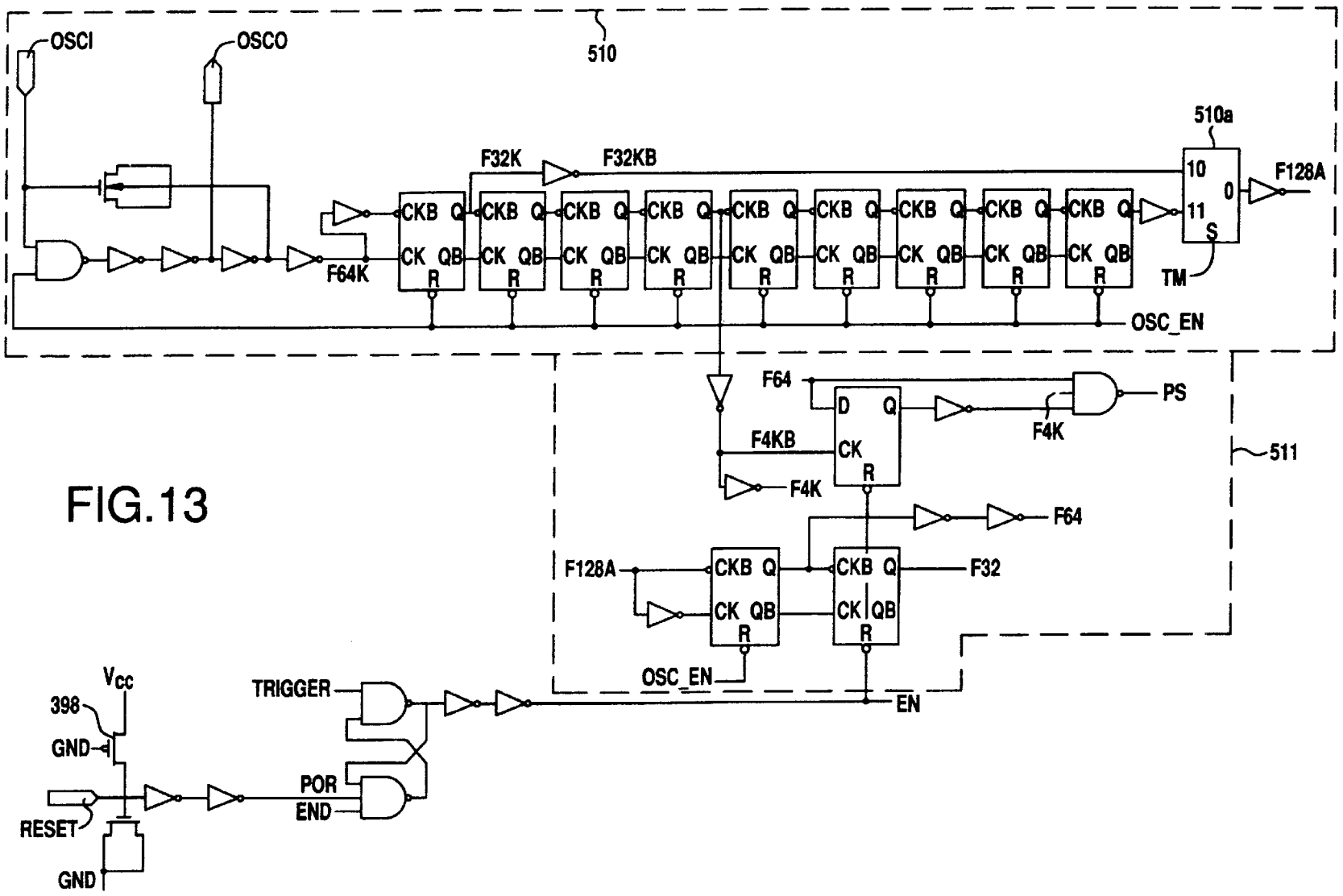
FIG. 13 is a circuit wiring diagram of the oscillator, time base and a portion of the trigger control of the electric circuitry of FIG. 11.
Figure 14B:
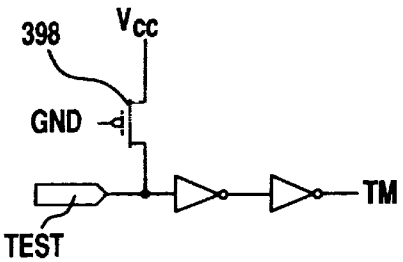
FIG. 14B is a circuit wiring diagram of still another portion of the trigger control of the electric circuitry of FIG. 11.
Figure 15:
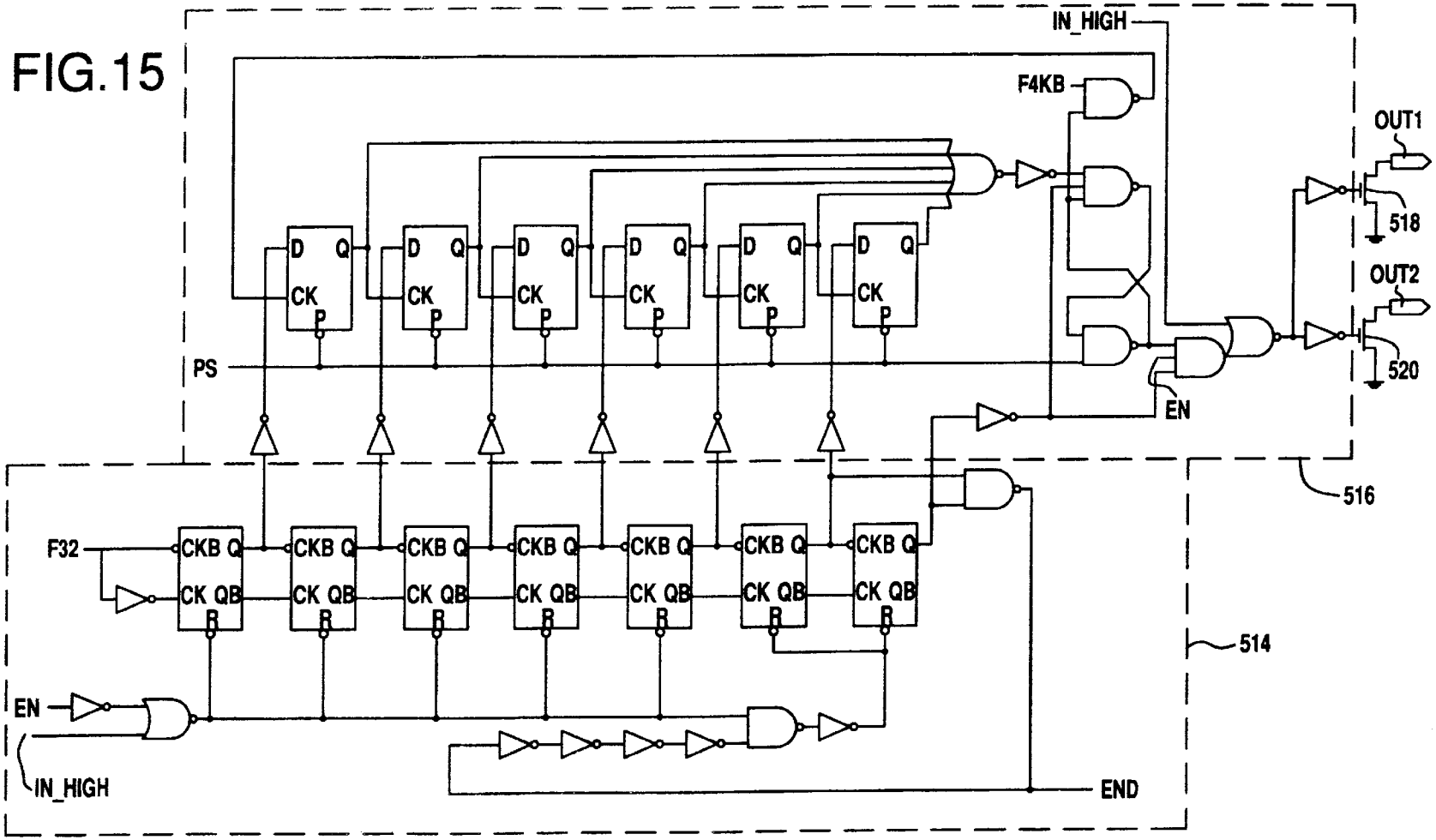
FIG. 15 is a circuit wiring diagram of the down counter and pulse width modulator of the electric circuitry of FIG. 11.

The preferred circuit wiring diagrams for the various elements of integrated circuit 500 are shown in FIGS. 13–15, and a detailed description thereof is not provided since this would be readily apparent to one skilled in the art.

Thus, with the last embodiment of the present invention, a fading effect will be emulated when switch 398 is opened, that is, goes from an ON position to an OFF position. During this fading effect, if switch 398 is again closed (ON), integrated circuit 500 will disregard the signal from switch 398 and will not interrupt the fading cycle until it completes the fading cycle. If switch 398 remains ON at the end of the fading cycle or is subsequently closed (ON), LEDs 390*a* and 390*b* will be illuminated, and thereafter, when switch 398 is again released (OFF), another fading cycle will occur.

It will therefore be appreciated that, with the present invention, a fading effect is achieved and continues for a predetermined period, regardless of whether switch 398 is again closed. Thus, for example, if a person is running fast, whereby coil spring 400 moves up and down rapidly, there will still be a fading effect for a predetermined period of time, regardless of the fact that the switch is continuously opened and closed during the fading period.

Further, as shown in FIGS. 11 and 13, trigger control 512 also includes a RESET input and circuitry associated therewith for resetting integrated circuit 500 in order to initialize the same. The output EN from this circuitry is supplied to reset inputs of time base 511 to reset the same.

In order to determine that the circuitry is operating correctly, and as shown in FIGS. 11 and 14B, trigger control 512 also includes a TEST input and circuitry associated therewith for testing integrated circuit 500 in order to determine that it is operating correctly. In this regard, the output signal TM produced by trigger control 512 is supplied to circuit 510*a* (FIG. 13) at the output of oscillator 510 to force oscillator 510 to produce a test signal F128A which is supplied to an input of time base 511. The signal TM functions as an acceleration signal to speed up the operation when signal TM is supplied during a wafer testing procedure.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A light module for use with a light source mounted to footwear, comprising:

a power supply for supplying power;

a switch connected between said power supply and said light source and having an open state and a closed state such that said light source is activated to emit light at an illumination intensity when said switch is in said closed state; and a fading control circuit connected to the power supply, the light source and the switch for controlling the supply of power to the light source when the switch changes from the closed state to the open state such that the illumination intensity of light emitted from the light source decreases over time to produce a fading effect for a first predetermined period of time, regardless of whether the switch changes back from the open state to the closed state during said first predetermined period of time.

2. A light module according to claim 1, wherein said fading control circuit is an integrated circuit.

3. A light module according to claim 1, wherein said fading control circuit supplies full power to said light source when said switch is in said closed state in response to closing of the switch, except during said first predetermined period of time having said fading effect.

4. A light module according to claim 1, wherein said fading control circuit includes:

a timing circuit for producing timing signals;

a power control circuit for controlling the amount of power supplied to said light source; and a trigger control circuit for controlling operation of said power control circuit in response to a condition of said switch such that said power control circuit reduces the supply of power to the light source over time when the switch changes from the closed state to the open state to produce said fading effect for said first predetermined period of time, regardless of whether the switch changes back from the open state to the closed state during said first predetermined period of time.

5. A light module according to claim 4, wherein said power control circuit includes:

a down counter which is enabled by said trigger control circuit when said switch changes from said closed state to said open state; and a pulse width modulator which transforms an output from said down counter into a pulse width modulated signal corresponding to an amount of power to be supplied to said light source.

6. A light module according to claim 5, wherein said pulse width modulator includes a digital to analog converter.

7. A light module according to claim 5, wherein said down counter provides an output signal corresponding to a decay waveform for said first predetermined period.

8. A light module according to claim 7, wherein said down counter further produces an output signal corresponding to a quiescent state during a second predetermined period following said first predetermined period, and said trigger control circuit prevents activation of said fading control circuit to prevent the supply of power to said light source during said second predetermined period.

9. A light module according to claim 8, wherein said first predetermined period is approximately two seconds and said second predetermined period is approximately one second.

10. A light module according to claim 5, further comprising a switching transistor connected between the pulse width modulator of the fading control circuit and the light source, for controlling a voltage level supplied to the light source in order to control illumination intensity of the light source.

11. A light module according to claim 4, wherein said timing circuit includes:

an oscillator for producing an oscillation signal of a predetermined frequency; and a time base circuit that provides signals having different clock frequencies for controlling said fading control circuit.

12. A light module according to claim 1, wherein said switch includes a spring connected in a cantilevered manner such that one end of said spring is electrically connected to said power supply and an opposite free end of said spring intermittently connects with a contact to provide said opening and closing of said switch, whereby to intermittently connect said power supply with said fading control circuit.

13. A light module according to claim 12, wherein said spring is a coil extension spring.

14. A light module according to claim 1, wherein said power supply includes at least one battery.

15. A light module according to claim 1, wherein said light source includes at least one light emitting diode.

* * * * *